US005382937A

United States Patent [19]

Saitoh et al.

[11] Patent Number: 5,382,937

[45] Date of Patent: Jan. 17, 1995

[54] COIL DEVICE

[75] Inventors: Yutaka Saitoh; Shinichirre Stro; Yukiharu Kimoshita, all of Tokyo, Japan

[73] Assignee: TDK Corporation, Tokyo, Japan

[21] Appl. No.: 922,676

[22] Filed: Jul. 30, 1992

[51] Int. Cl.[6] ..... H01F 15/02

[52] U.S. Cl. ..... 336/178; 336/65; 336/83; 336/134

[58] Field of Search ..... 336/65, 83, 178, 212, 336/134

[56] References Cited

U.S. PATENT DOCUMENTS

| | | | |
|---|---|---|---|
| 952,692 | 3/1910 | Thordarson | 336/65 |
| 2,220,126 | 11/1940 | Six et al. | 336/134 X |
| 2,483,900 | 10/1949 | Hardenberg et al. | 336/134 |
| 2,494,579 | 1/1950 | Pimlott et al. | 336/134 X |
| 2,664,795 | 1/1954 | Tone | 336/134 X |
| 3,078,429 | 2/1963 | Wiesner . | |
| 3,138,774 | 6/1964 | Derbyshire et al. | 336/65 X |
| 3,743,990 | 7/1973 | Renskers et al. | 336/65 X |
| 4,047,138 | 9/1977 | Steigerwald | 336/178 X |
| 4,117,436 | 9/1978 | MacLennan | 336/83 X |
| 4,149,135 | 4/1979 | Roespel et al. | 336/83 X |
| 4,257,025 | 3/1981 | Hareland | 336/178 X |
| 4,766,406 | 8/1988 | Kurgan et al. | 336/65 |
| 4,924,200 | 5/1990 | Kitahara et al. | 336/65 |
| 4,990,881 | 2/1991 | Ooyabu | 336/178 X |

FOREIGN PATENT DOCUMENTS

| | | | |
|---|---|---|---|
| 1220027 | 7/1966 | Germany | 336/210 |
| 1814284 | 8/1969 | Germany | 336/83 |
| 62741 | 5/1976 | Japan . | |
| 75545 | 6/1976 | Japan . | |
| 50372 | 12/1980 | Japan . | |
| 24363 | 6/1981 | Japan . | |
| 236181 | 8/1925 | United Kingdom | 336/178 |
| 887204 | 1/1962 | United Kingdom | 336/83 |

*Primary Examiner*—Leo P. Picard
*Assistant Examiner*—L. Thomas
*Attorney, Agent, or Firm*—Knobbe, Martens, Olson & Bear

[57] ABSTRACT

A coil device which can accurately maintain the proportion of voltage caused by the change of the current flowing in a coil device, wherein the outside magnetic substance and the coil are fixed during an assembly of the coil device so that inside magnetic substance can be adjustably moved, or the outside magnetic substance and the inside magnetic substance are fixed so that the coil can be adjustably moved, or only the outside magnetic substance is fixed so that the coil and the inside magnetic substance can be adjustably moved therein. In addition, the coil device produces only small errors in inductance and a minimum leakage flux.

10 Claims, 7 Drawing Sheets

COIL DEVICE

FIELD OF THE INVENTION

This invention relates to the improvement of a coil device which is utilized as a transformer or a choke coil.

BACKGROUND OF THE INVENTION

Conventionally, the following coil devices, which utilize a magnetic core having gaps used for the transformer or the choke coil, have been employed such as: 1) the coil device utilizing an opposed pair of E-shaped cores (disclosed in Japanese Patent Publication No. 50372/1980) made from magnetic materials such as ferrite which is made from the baked oxide such as nickel, iron or zinc, wherein gaps are provided on ends of the center of a leg in order to prevent magnetic saturation, 2) a combination of E-shaped and I-shaped cores (disclosed in Japanese Patent Publication No. 24363/1981), wherein the gaps are provided in the end of the center leg of the E-shaped core, and 3) the coil device in which the coil is wound on the drum-shaped core.

However, with the conventional invention in which a wire is wound on the magnetic core having the gaps, it often causes errors in inductance (that is different from the expected value), which is most often derived from errors in the dimension of the magnetic core, errors during the production of the gaps and errors in magnetic permeability of the core. For example, when an effective permeability is 100, the errors (variation) of the inductance of the choke coil is ±21% in E-E type, and is ±16% in E-I type. On the other hand, with the invention using a drum core only, the error is relatively small (±6%). However, it has a problem that leakage flux becomes extremely large.

SUMMARY OF THE INVENTION

In view of the foregoing facts, an objective of the present invention is to provide a coil device having small variation of the inductance and little leakage flux.

In order to accomplish the above objective, the coil device of the present invention comprises: an outside magnetic substance forming an endless loop, an inside magnetic substance formed inside of the outside magnetic substance and the coil wound on the inside magnetic substance, wherein the gaps are provided between said outside magnetic substance and said inside magnetic substance. The coil device of the present invention is characterized to provide a holding device which has space to be able to adjust and move a relative position between the outside magnetic substance and the inside magnetic substance during an assembly of the coil device.

In the coil device of the present invention structured as in the foregoing, it has become possible to adjust the value of the inductance about 25% experimentally by changing the relative position between the outside magnetic substance and the inside magnetic substance.

Furthermore, since the outside magnetic substance confines the inside magnetic substance and the coil, the coil device of the present invention causes little leakage flux.

BRIEF DESCRIPTION OF THE DRAWINGS

FIG. 1 is an exploded view of the coil device of the present invention.

FIGS. 2 and 3 are exploded views of the other embodiments of the present invention.

FIG. 4 is a plan view of the coil device shown in FIGS. 1–3.

FIGS. 5 and 6 are plan views of the other embodiments of coil devices of the present invention.

FIG. 7 is a variable diagram of the inductance when one of the outside magnetic substance, the inside magnetic substance and the coil is moved.

FIG. 8 is a diagram showing the state of the leakage flux of the conventional coil device (using drum core).

FIG. 9 is a diagram showing the state of the leakage flux of the coil device of the present invention.

FIG. 10 is a diagram showing a relationship between direct superimposed current and the inductance.

DESCRIPTION OF THE PREFERRED EMBODIMENTS

Figure 1:
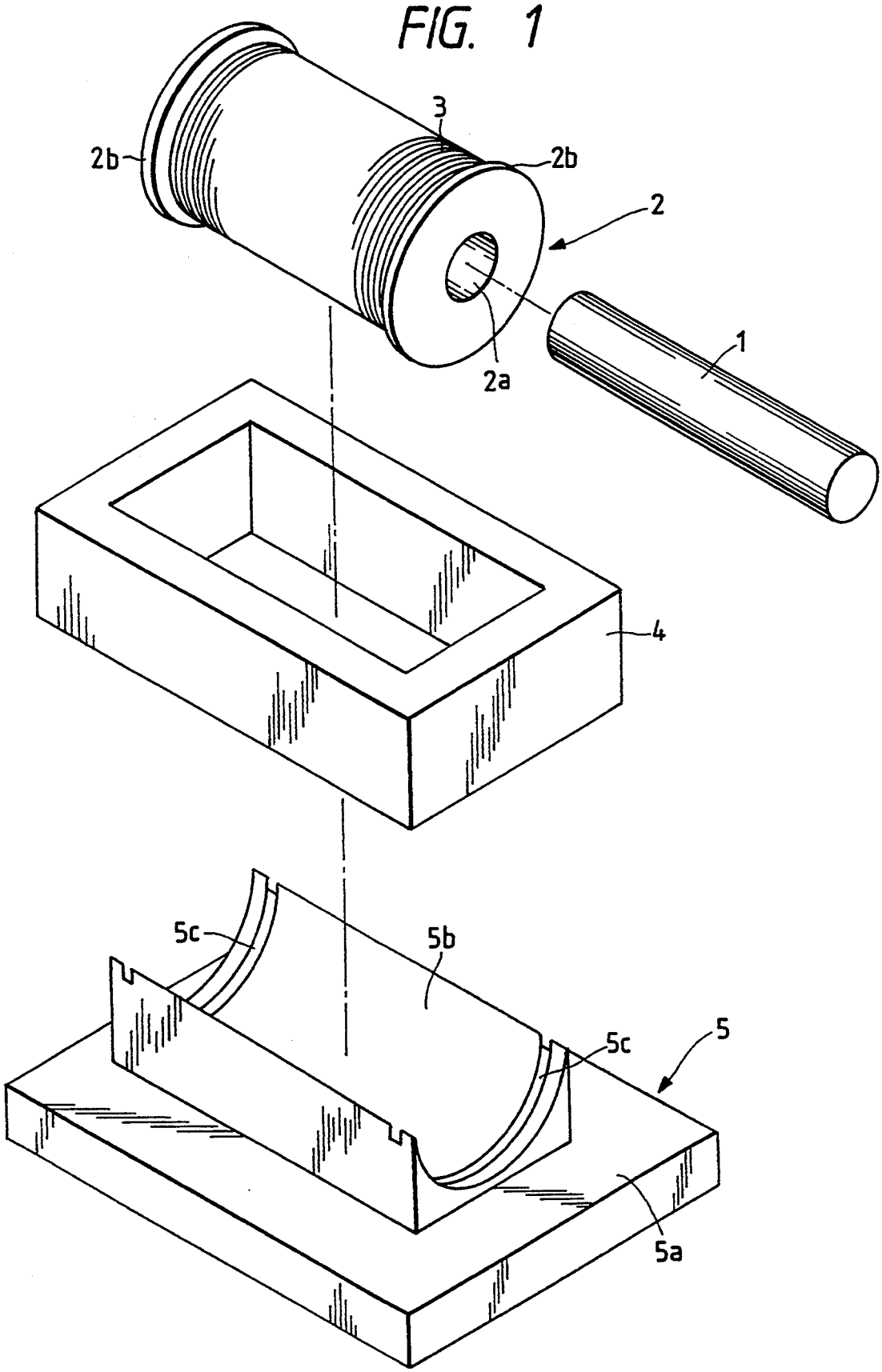
FIGS. 1–10 are embodiments of the present invention.

FIG. 1 is an exploded view of the coil device.

In FIG. 1, reference numeral 1 is the inside magnetic substance, reference numeral 2 is a bobbin, reference numeral 3 is the coil, reference numeral 4 is the outside magnetic substance, and reference numeral 5 is the holding device.

The inside magnetic substance 1 is made from ferrite magnetic substance which is a bar-shaped (or pillar-shaped), and is adapted to be inserted in a through hole 2*a* of the bobbin 2 which is made from resin. The bobbin 2 has flanges 2*b* on both its ends, wherein a tube is formed between said flanges 2*b*, and the coil 3 is wound in a predetermined times on the periphery of said tube. The outside magnetic substance 4 made from the ferrite is formed in a square-shape forming an endless loop and has space in which said bobbin 2 can be placed. The holding device 5 is comprised of an outside plate 5*a* on which the outside magnetic substance 4 is placed and an inside plate 5*b* in which the bobbin 2 having the coil 3 thereon is placed. The outside plate 5*a* and the inside plate 5*b* are glued and fixed to each other. The surface of the outside plate 5*a* is larger than that of the outside magnetic substance 4. When the outside magnetic substance 4 is placed on the outside plate 5*a*, it can be slidable moved in a transverse direction. The upper side of the inside plate 5*b* forms a semicircular surface. On both ends of the inside plate 5*b*, two grooves 5*c* are provided along the semicircular surface, wherein the flanges 2*b* of the bobbin 2 having the coil 3 thereon are adapted to be engaged and fixed in the grooves 5*c*.

The holding device 5 is, for example, a non-magnetic mold made from synthetic resin. The inside magnetic substance 1 is glued and fixed beforehand in the bobbin 2 which is fixed on the holding device 5.

Figure 4:
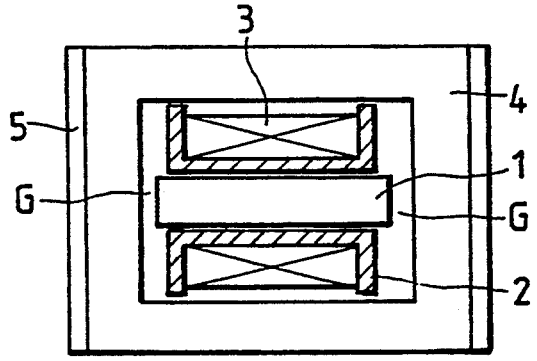

FIG. 4 is a plan view of the coil device assembled as in the foregoing, wherein gaps G are provided between both ends of the inside magnetic substance 1 and the outside magnetic substance 4. The coil device structured as in the foregoing provides the capability to adjust the inductance by measuring characteristics of the coil device and adjusting the relative position (space between the gaps G) between the outside magnetic substance and the inside magnetic substance to the appropriate position. The outside magnetic substance 4 is placed on the outside plate 5*a*, wherein adhesive resin to be hardened by ultraviolet or a fan heater is applied in advance.

Figure 2:
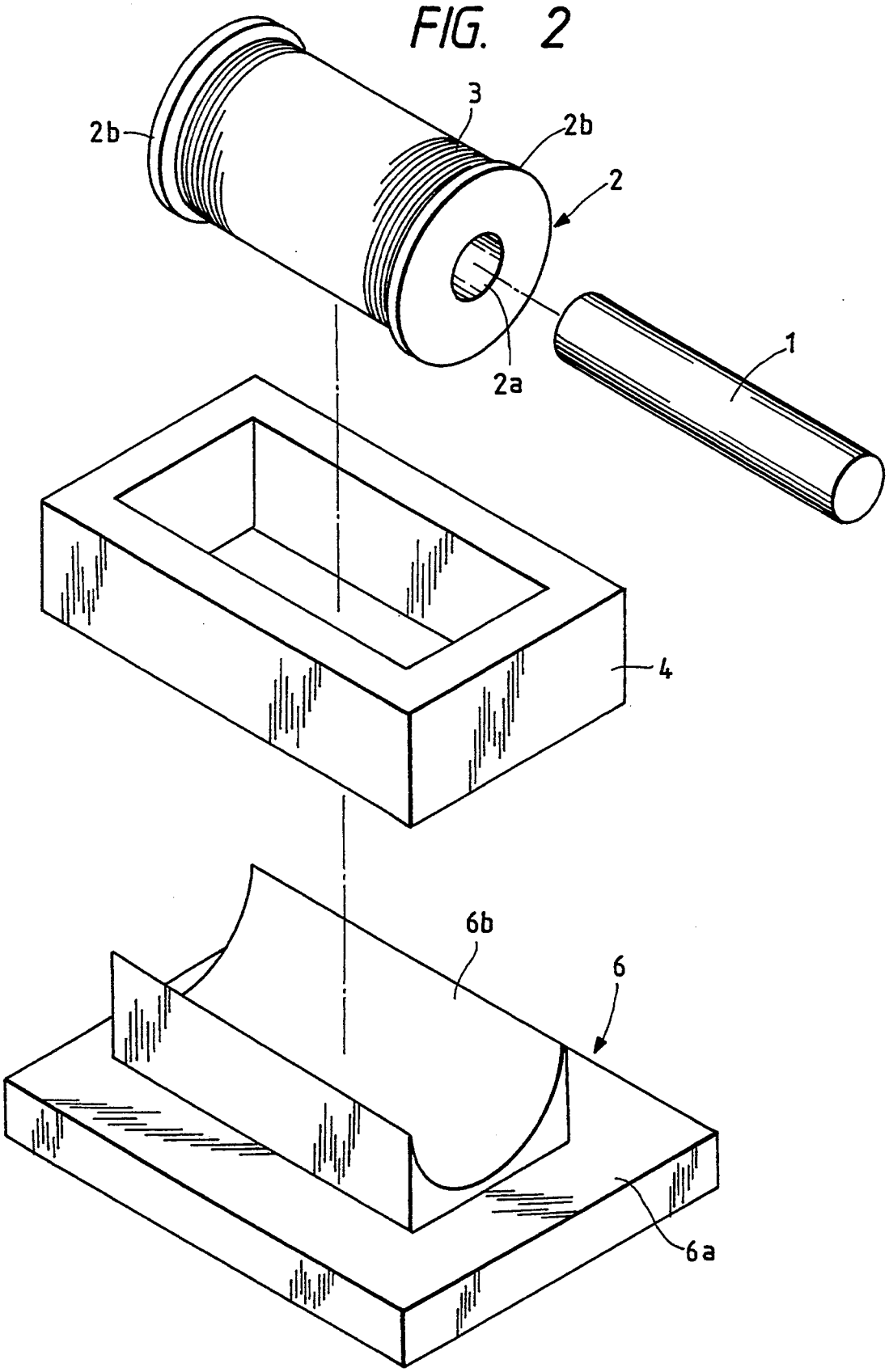

FIG. 2 is an exploded view of another embodiment of the present invention showing a different structure of a holding device 6 from that of FIG. 1. The holding device 6 is structured as: an inside plate 6*b* forms a semicircular surface which does not have grooves to fix the bobbin, the outside magnetic substance 4 is fixed on the outside plate 6*a*, the bobbin having the coil, wherein the inside magnetic substance is inserted and fixed, is movably placed on said inside plate 6*b*. The plan view of said holding device 6 is as described in FIG. 4. After adjusting the inductance by moving said bobbin in the left/right directions, the bobbin is fixed with the adhesive resin as in the foregoing. In this case, if the bobbin and the inside magnetic substance are arranged to be able to move separately, only one of either the coil or the inside magnetic substance can be moved.

Figure 3:
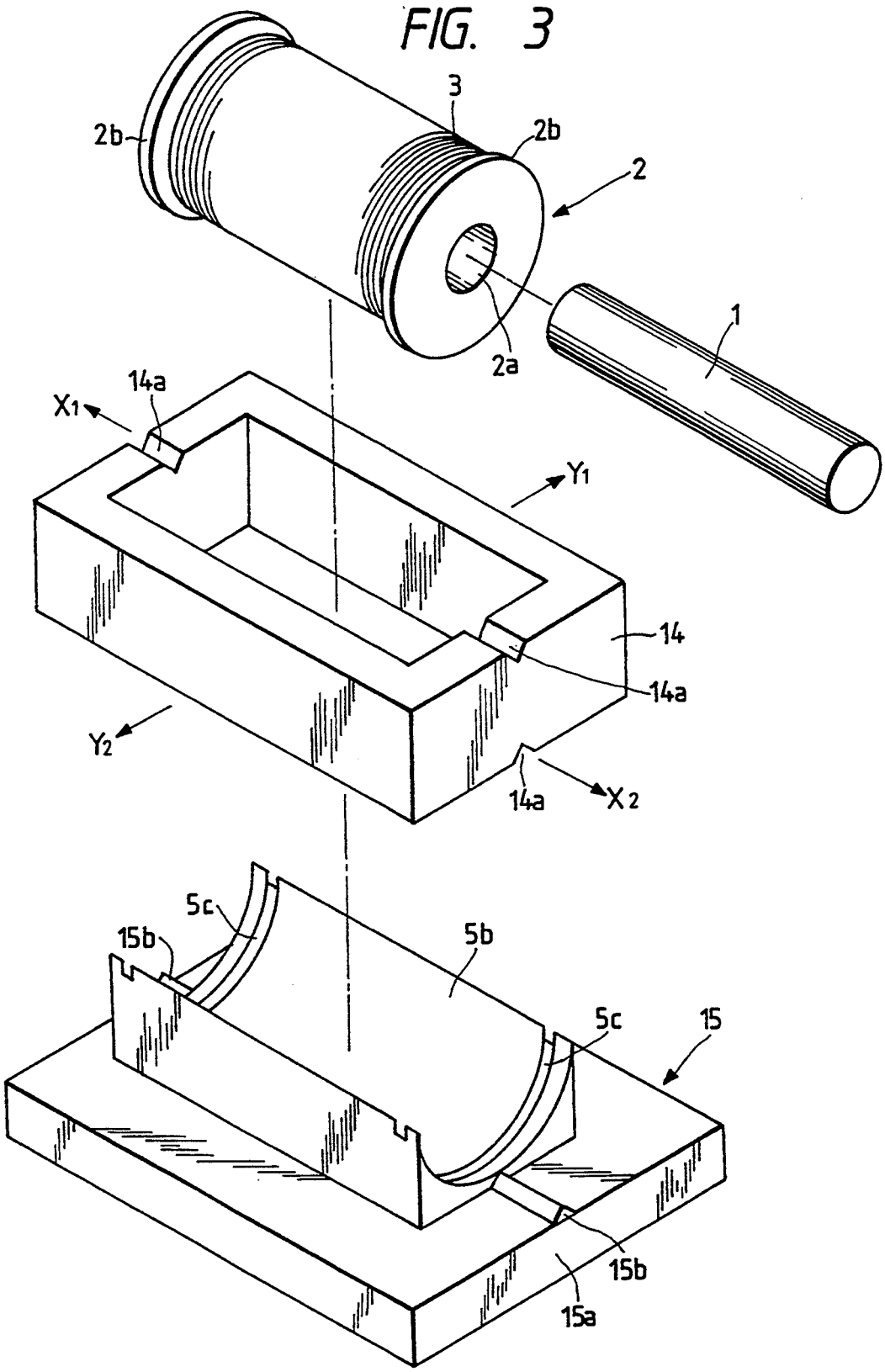

Next, with reference to FIG. 3, another preferred embodiment of the coil device in the present invention is described in detail. In FIG. 3, the identical parts used in FIG. 1 are designated by the same reference numerals, and the explanation is given only to the important element. Differences between FIG. 3 and FIG. 1 are in that: the coil device of FIG. 3 includes the outside magnetic substance 14, in comparison with the outside magnetic substance 4 in FIG. 1, wherein concave portions 14*a* as moving guides are provided in the upper/lower and left/right sides; the coil device of FIG. 3 also includes the holding device 15 having the outside plate 15*a*, wherein projecting portions 15*b* corresponding to said concave portions 14*a* are provided on the outside plate 15*b* in both left and right directions. Furthermore, in the embodiment of FIG. 3, said concave portions 14*a* are provided on the outside magnetic substance 14 in the upper/lower and left/right sides. It is also acceptable to provide the concave portions 14*a* only on the lower side (which faces to the holding device 5). However, if said concave portions 14*a* are provided in both upper and lower sides, it is rather advantageous because it is not necessary to orient a top or bottom of the outside magnetic substance.

The coil device structured as in the foregoing allows the adjustment of the inductance by measuring characteristics of the coil device and adjusting the relative position of the outside magnetic substance 14 which is placed on the outside plate 15*a*. Namely, the bobbin 2 having the coil 3 wound thereon and the inside magnetic substance 1 are fixed onto the inside plate 5*b*, and the projecting portions 15*b* are engaged in the concave portions 14*a*. Said outside magnetic substance 14 is adjustably moved to the $X_1$ and $X_2$ directions and fixed to the appropriate position. In this case, since said projecting portions 15*b* and the concave portions 14*a* are engaged, the outside magnetic substance 14 is not slid in the $Y_1$ and $Y_2$ directions. Thus, the adjustment of the inductance can be achieved more accurately.

In the above embodiments, the coil device, which is comprised of the outside magnetic substance forming the endless loop of square-shape and the bar-shaped inside magnetic substance, has been described. However, it does not have to be limited to the above structure, and other structures having different shapes can be also allowed.

Figure 5:
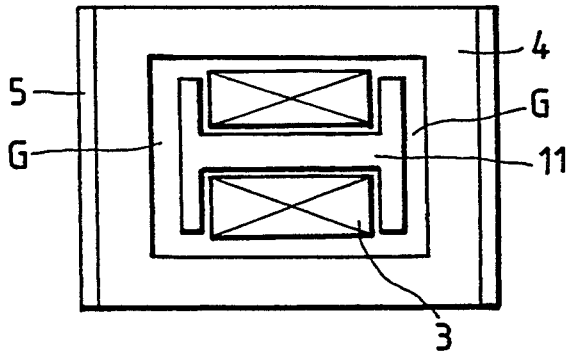
Figure 6:
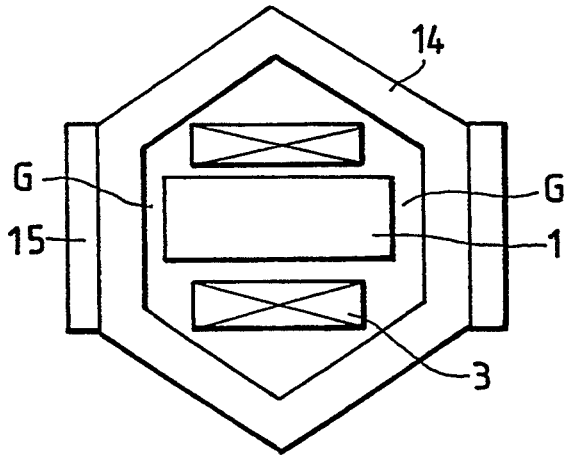

For example, the embodiment in FIG. 5 shows the structure, wherein the H-shaped (or drum type) inside magnetic substance 11 having the coil 3 wound thereon is positioned in the square-shaped outside magnetic substance 4. The embodiment in FIG. 6 shows the structure, wherein the bar-shaped inside magnetic substance 1 having the coil 3 wound thereon is positioned in the hexagon-shaped outside magnetic substance 14, and the hexagon-shaped holding device 15 which matches the shape of the outside magnetic substance 14 is utilized therein. For both of the above embodiments, the gaps G are formed between the outside magnetic substance and the inside magnetic substance.

The foregoing embodiments show the structure utilizing the bobbin and the coil which is wound thereon. It is also acceptable to wind the coil directly on the inside magnetic substance without using the bobbin. In this case, it is not possible to move only the coil.

Figure 7:
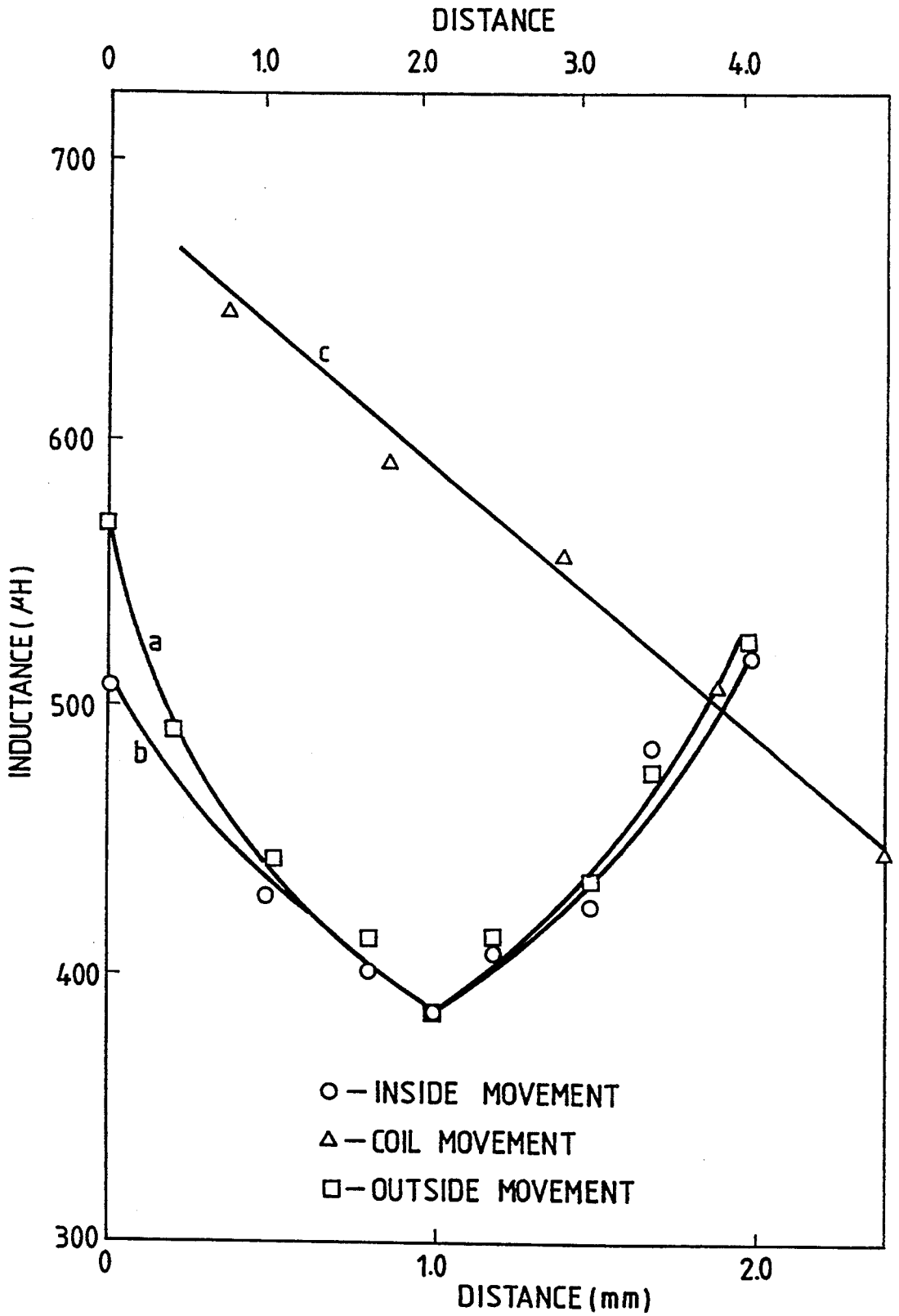

Referred to FIG. 7, operations and effects of the coil device in the present invention are described in detail. The upper side of the cross axis of the diagram shows the distance between the coil and the inside of one of the outside magnetic substance while the lower side, the distance between the inside of one of the outside magnetic substance and the inside magnetic substance. In the transverse axis is provided the inductance.

FIG. 7 shows the test results for the adjusting methods of the inductance as in the following:

a. When only the outside magnetic substance is moved against the inside magnetic substance and the coil.
b. When only the inside magnetic substance is moved against the outside magnetic substance and the coil.
c. When only the coil is moved against the outside magnetic substance and the inside magnetic substance.

As a result, the variable range of the inductance for a) is 38.4%, b) is 29.2% and c) is 38.0%. Thus, the coil device in the present invention allows the adjustment of the inductance by changing the relative positions of the outside/inside magnetic substance and the coil.

Figure 8:
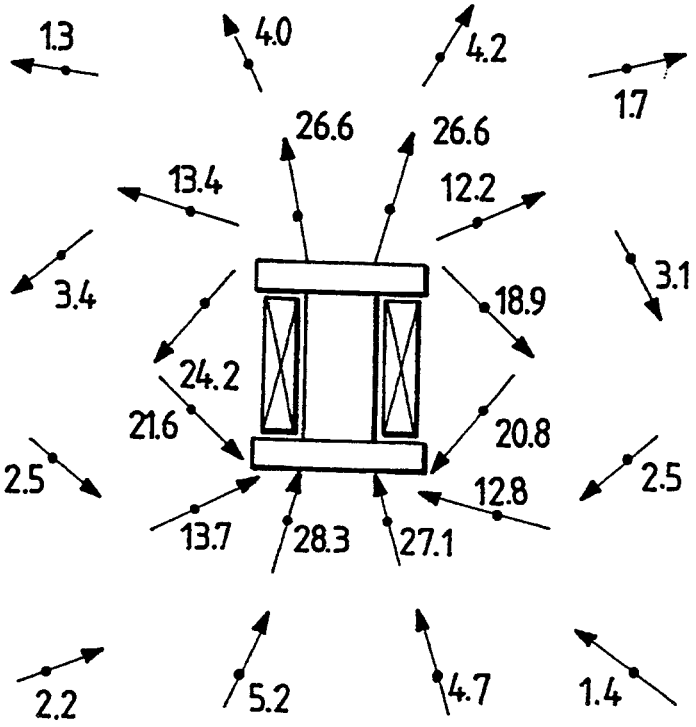
Figure 9:
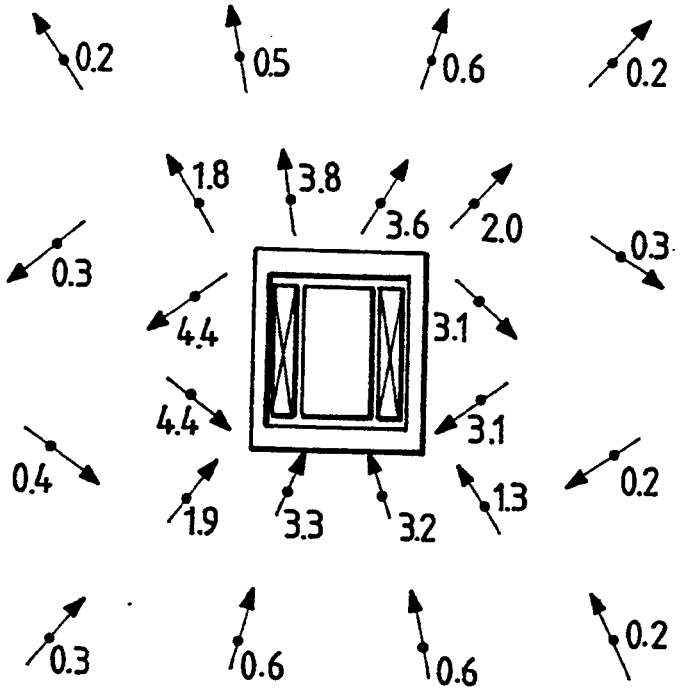

Furthermore, since the coil device of the present invention employs the outside magnetic substance having a closed loop with no gaps, it causes little leakage flux. Thus, the results shown in FIGS. 8 and 9 are obtained. FIG. 8 shows the leakage flux with the conventional coil device utilizing the drum core only. FIG. 9 shows the leakage flux of the coil device in the present invention as shown in FIG. 4. In FIGS. 8 and 9, the value of magnetic current, winding turns of the coil and the value of the inductance are equal, that is, flux induced is under the same conditions. The units used in both diagrams are gauss.

As obvious in the diagrams, when only the drum coil of FIG. 8 is used, it shows about 20 gauss of the leakage flux around the drum coil. However, when the coil device of the present invention shown in FIG. 9 is used, the leakage flux is one-sixth of that of in FIG. 8.

Figure 10:
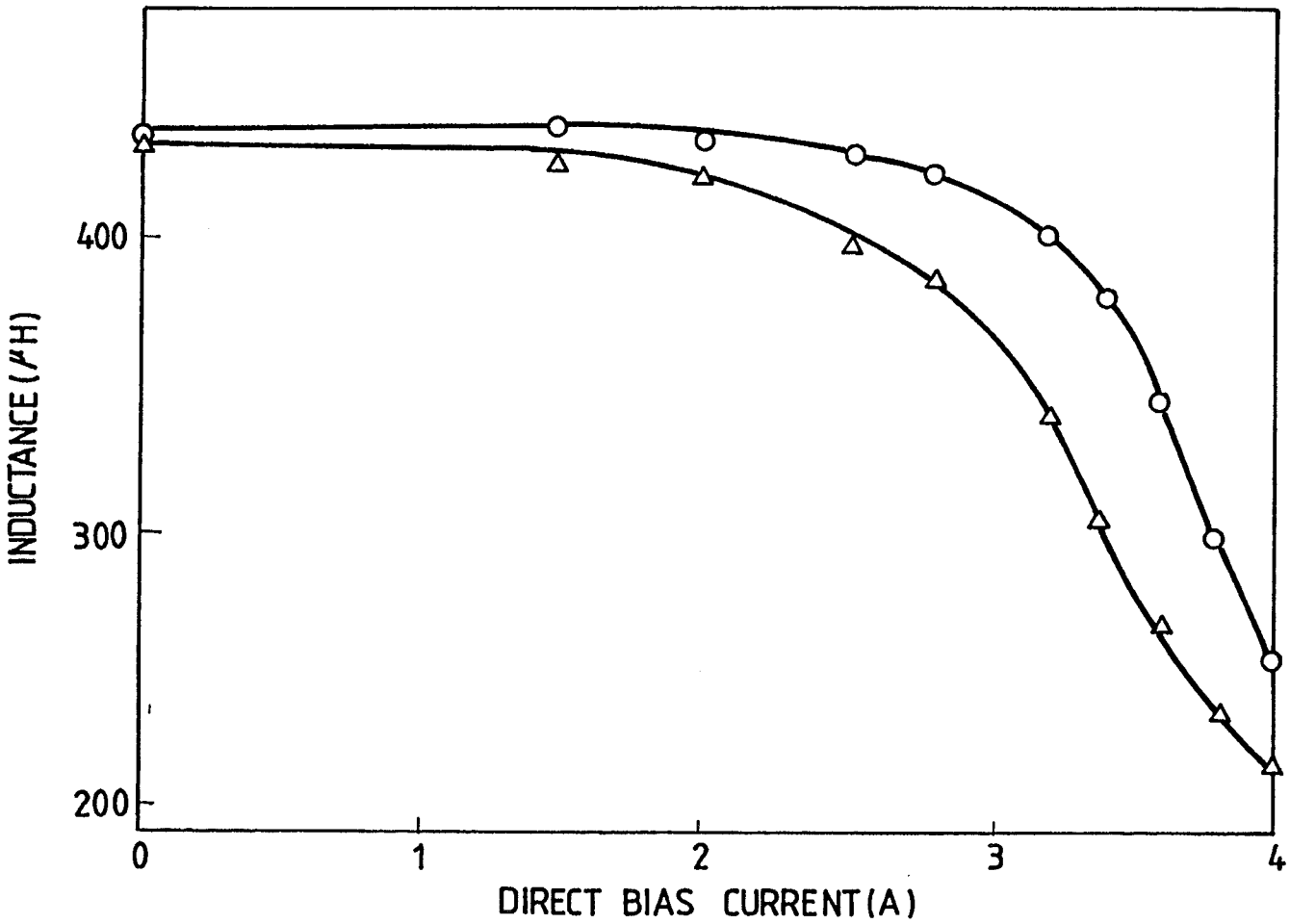

FIG. 10 shows characteristics of the direct superimposed current in the coil device. The cross axis shows direct bias current, and the transverse axle shows the inductance. In the diagram, a curve for the conventional invention comprising E-shaped cores shows that the inductance rapidly decreases with an increase of the direct bias current. On the other hand, the curve for the present invention comprising a □-shaped core and a cylindrical core is gentle in comparison with that of the conventional invention.

What is claimed is:

1. A coil device comprising:

an outside magnetic substance forming an endless loop;

an inside magnetic substance having a first end and a second end formed inside of said outside magnetic substance;

a coil wound on said inside magnetic substance;

a first gap provided between said outside magnetic substance and said first end of said inside magnetic substance;

a second gap provided between said outside magnetic substance and said second end of said inside magnetic substance;

a holding device for supporting said inside magnetic substance in a first position relative to said outside magnetic substance and for supporting said inside magnetic substance in a second position relative to said outside magnetic substance, wherein said first position corresponds to a first inductance value and said second position corresponds to a second inductance value.

2. A coil device as defined in claim 1, wherein said inside magnetic substance is inserted in a bobbin having flanges, and said coil is wound on said bobbin.

3. A coil device as defined in claim 1, wherein said holding device is comprised of an outside plate in which said outside magnetic substance is placed and an inside plate having concave portions for holding said inside magnetic substance with said coil wound thereon.

4. A coil device as defined in claim 2 or 3, wherein said bobbin further comprises grooves engaging said flanges of said bobbin, said grooves being provided on said concave portions of said inside plate of said holding device.

5. A coil device as defined in claim 1, 2 or 3, wherein said outside magnetic substance further comprises guide grooves and projecting portions engaged in said guide grooves, said guide grooves being provided on said outside magnetic substance, and said projecting portions being provided on said outside plate of said holding device.

6. A coil device as defined in claim 1, 2 or 3, wherein said outside magnetic substance has a shape selected from the group consisting of a square and a polygon.

7. A coil device as defined in claim 1, 2 or 3, wherein said inside magnetic substance has a shape selected from the group consisting of a bar and an H.

8. A coil device comprising:

an outside magnetic substance forming an endless loop;

an inside magnetic substance having a first end and a second end formed inside of said outside magnetic substance;

a coil wound on said inside magnetic substance;

a first gap provided between said outside magnetic substance and said first end of said inside magnetic substance;

a second gap provided between said outside magnetic substance and said second end of said inside magnetic substance;

a holding device for supporting said inside magnetic substance in a first position relative to said outside magnetic substance and for supporting said inside magnetic substance in a second position relative to said outside magnetic substance, wherein said first position corresponds to a first inductance value and said second position corresponds to a second inductance value, wherein said holding device is comprised of an outside plate in which said outside magnetic substance is placed and an inside plate having concave portions for holding said inside magnetic substance with said coil wound thereon.

9. A coil device as defined in claim 8, wherein said bobbin further comprises grooves engaging said flanges of said bobbin, said grooves being provided on said concave portions of said inside plate of said holding device.

10. A coil device as defined in claim 8, wherein said outside magnetic substance further comprises guide grooves and projecting portions engaged in said guide grooves, said guide grooves being provided on said outside magnetic substance, and said projecting portions being provided on said outside plate of said holding device.

* * * * *